US008120444B2

(12) United States Patent
Haunberger et al.

(10) Patent No.: US 8,120,444 B2
(45) Date of Patent: Feb. 21, 2012

(54) CIRCUIT FOR SEPARATING OR COMBINING HIGH FREQUENCY POWER

(75) Inventors: Thomas Haunberger, Bad Reichenhall (DE); Stefan Berger, Rohrdorf (DE)

(73) Assignee: Kathrein-Werke KG, Rosenheim (DE)

( * ) Notice: Subject to any disclaimer, the term of this patent is extended or adjusted under 35 U.S.C. 154(b) by 280 days.

(21) Appl. No.: 12/516,726

(22) PCT Filed: Oct. 31, 2007

(86) PCT No.: PCT/EP2007/009464

§ 371 (c)(1),
(2), (4) Date: Jun. 3, 2009

(87) PCT Pub. No.: WO2008/064758

PCT Pub. Date: Jun. 5, 2008

(65) Prior Publication Data

US 2010/0001811 A1 Jan. 7, 2010

(30) Foreign Application Priority Data

Nov. 30, 2006 (DE) ..... 10 2006 056 618

(51) Int. Cl.
*H01P 5/20* (2006.01)
*H01P 5/12* (2006.01)

(52) U.S. Cl. ..... 333/132; 333/127; 333/121; 333/136

(58) Field of Classification Search ..... 333/121, 333/127, 132, 136, 123, 126, 128, 129
See application file for complete search history.

(56) References Cited

U.S. PATENT DOCUMENTS

| | | | |
|---|---|---|---|
| 3,428,920 | A | 2/1969 | Oleksiak |
| 5,880,648 | A | 3/1999 | Aves et al. |

FOREIGN PATENT DOCUMENTS

| | | |
|---|---|---|
| DE | 43 29 361 | 3/1995 |
| EP | 1 239 550 | 9/2002 |
| EP | 1 250 721 | 3/2004 |
| JP | 11-168308 | 6/1999 |

OTHER PUBLICATIONS

International Search Report for PCT/EP2007/009464, mailed Feb. 21, 2008.
Prospectus, Kathrein-Werke KG—Base Station Antennas for Mobile Communication, Catalog 03.99, pp. 159-167.

*Primary Examiner* — Robert Pascal
*Assistant Examiner* — Kimberly Glenn
(74) *Attorney, Agent, or Firm* — Nixon & Vanderhye PC

(57) ABSTRACT

An improved component for the separation or combination of high frequency outputs includes a coaxial input port located at the front end of the outer conductor. At the opposite end of the outer conductor, a head is located with at least two, and preferably three or four, single ports which cover the outer conductor connections. The head with the single ports is built as a single part to avoid any mechanical connection junctions. The head with the single ports which form integral outer conductor connectors consists of a forged part or a cast part.

18 Claims, 6 Drawing Sheets

CIRCUIT FOR SEPARATING OR COMBINING HIGH FREQUENCY POWER

This application is the U.S. national phase of International Application No. PCT/EP2007/009464 filed 31 Oct. 2007, which designated the U.S. and claims priority to Germany Application No. 10 2006 056 618.1 filed 30 Nov. 2006, the entire contents of each of which are hereby incorporated by reference.

The invention relates to a circuit for separating or combining high frequency power in accordance with the preamble of claim 1.

A generic circuit for separating and combining high frequency power is known, for example, from the brochure "Kathrein-Werke KG—Base Station Antennas for Mobile Communication, catalogue 03.99".

The circuit is housed, for example in an elongate housing, at an end face of which what is known as a summation port is provided as an input and at the opposite end of which a first single port, for example, is provided as an output. Between one and three further connections are provided adjacent to said output at the end of the longitudinal sides of the housing, which connections act as outputs for the outcoupled power portions when HF power is supplied at the summation port (which acts as an input). In other words, the supplied signals are split between two, three or, for example, four outputs depending on the number of outputs provided.

The connection interfaces are normally 7/16 coaxial connections with threaded couplings, for example in accordance with IEC standard 169-4, or what are known as N connectors in accordance with IEC standard 169-16.

Dividers of this type for high frequency signals are normally used within the field of mobile radio or radio technology, that is to say in corresponding mobile radio or radio systems. Dividers of this type are also sometimes referred to as power splitters. In particular, if the power is separated differently at the outputs, reference is made to what are known as power tappers.

With reference to FIGS. 1 and 2, a known divider of this type in accordance with the prior art, i.e. a circuit for splitting or combining high frequency power, is shown in greater detail and will be described hereinafter.

FIG. 1 shows the outer conductor 1 of the divider, which may have a rectangular or square cross-section for example. In a variant, the cross-section of the housing 1' forming the outer conductor 1 may also be configured so as to be of a different shape, for example annular.

This outer conductor 1 consists of a machined profiled part which is mostly made of aluminum. An extruded profiled part is preferably used in this case.

A first single port 4 for example is provided at the lower end 1*a* of the outer conductor 1, which single port may also be referred to hereinafter as a summation port.

At the opposite end-face end 1*b*, which is also referred to hereinafter as the upper end, a second single port 5*a* for example may be provided which acts as an output when HF power to be separated is supplied at the first single port 4.

A third, a fourth or for example even a fifth single port 5*b*, 5*c* and 5*d* (or even more) may, for example, be provided adjacent to said end-face upper end 1*b* on the side faces 1*c* of the housing-shaped outer conductor 1, via which ports the HF power supplied by the summation port 4 can be supplied to the circuits which can be connected to said single ports 5*b* to 5*d* (or, vice-versa, by supplying HF energy via the single ports 5*a* to 5*d* the combined energy may be supplied to the summation port 4).

As can be seen, in particular from the cross-sectional view shown in accordance with FIG. 2 of a divider of this type known from the prior art, the outer conductor 1 is hollow on the inside and comprises a longitudinal hole 9 in which an inner conductor 11, which is separate from the outer conductor 1, is arranged, which inner conductor is supported and held in place relative to the outer conductor 1, at least indirectly, via insulating holders 13 (insulator rings).

The single ports 5*a* to 5*d* normally consist of coaxial plug-in connectors 15 which, for example, are each fixed via four single screws 17 which can be screwed into corresponding threaded holes 19 in the housing of the outer conductor 1. The coaxial plug-in connectors 15 thus comprise threaded couplings, via which the entire ready-made socket, for example matched to 50Ω, is fixed to the housing 1 using the aforementioned screws.

The coaxial plug-in connectors 15 are configured as a plurality of parts, as can be seen in particular from the cross-sectional view according to FIG. 2. They each comprise an inner conductor 21 and inner conductor sockets 22 arranged axially thereon, a disc-shaped insulating support 13 supported on each of the inner conductor sockets and an outer conductor socket 24, which is supported outwardly between the insulating support 23 and the tubular outer conductor connection support 25 which, in turn, is provided with an outer thread in such a way that it is possible, in this case, to screw on a coaxial cable with a corresponding connection socket provided with an inner thread for example, thus ensuring contact with an inner and outer conductor.

As can be seen in particular from FIG. 2, inner conductor extension pins 26 are provided in the axial extension of the inner conductor 21, which pins are supported on and screwed into the transformation inner conductor 11 extending through the outer conductor 1 in the axial longitudinal direction.

The aforementioned inner conductors 21 and the inner conductor extension pins 26 contactlessly penetrate a radial hole 28 in the housing 1' acting as an outer conductor 1.

The single port 5*a* arranged on the upper end-face end 1*b* comprises a corresponding inner conductor 21 which is also screwed into a portion of the transformation inner conductor 11 from its position above and is electrically contacted therewith.

A conventional divider of this type, whether used as a divider, splitter or tapper, presents drawbacks regarding intermodulation caused by a relatively high number of contact points, some of which have a large surface area. In addition, contact corrosion may also take place at the connection points between the separate line portions which are in contact, even if the sockets are assembled so as to be tight relative to the outer face of the housing 1 by way of annular seals 27. It is extremely important for the parts to fit together accurately. In addition, assembly is also extremely complex owing to the relatively high number of contact points.

A conventional circuit for separating or combining frequencies is also known from U.S. Pat. No. 3,428,920. In this case a divider with a head piece is known. The head piece is spherical and comprises cylindrical connection pieces arranged so as to be offset in the peripheral direction, which connection pieces are inserted into corresponding holes in the housing-shaped head piece. The housing-shaped head piece is not only mechanically connected to the outer conductors, but these together form the outer conductor. The inner conductor is held in these cylindrical outer conductors in an insulated manner. In this case, similarly to the prior art according to FIGS. 1 to 2 and mentioned at the outset, the single ports are coaxial plug-in connectors.

Lastly, a power combiner or power divider is also known from U.S. Pat. No. 5,880,648. The divider comprises a head piece with a plurality of individual components which are connected to a common assembled head piece which can be easily handled.

The object of the present invention is therefore to develop a circuit for separating or combining power frequencies, which reduces or minimizes the aforementioned drawbacks.

The object is achieved according to the invention in accordance with the features disclosed in claim 1. Advantageous embodiments of the invention are given in the sub-claims.

Within the scope of the solution according to the invention, a circuit for separating or combining HF power is provided which offers considerable advantages over the prior art.

The invention is characterized by a compact construction which can be adjusted over an extremely wide range, for example from 350 to 3800 MHz.

Since a one-piece head piece with corresponding connections is used within the scope of the invention, problems regarding intermodulation are avoided. Owing to the fact that a separate mechanical connection point between the connection sockets and the divider head is avoided, contact corrosion at these points is also prevented. Since the connection head is not only preferably integrally configured but is also made of a consistent material, any possible problems regarding intermodulation and contact erosion are avoided.

In accordance with the invention, the one-piece connection head consists of a forged part, a cast part or a milled part. Any suitable materials may be considered, for example brass. The outer conductor may also consist of a corresponding metal tube, for example in the form of a machined profiled part, a turned part or an extruded part. In this case also, any suitable materials may be considered.

It has proven to be particularly advantageous within the scope of the invention if identical component parts can always be used for the connections (irrespective of whether the device is used as a two-way, three-way, four-way or general multi-way divider), since the inner conductors are of the same length or may be of the same length for all connection outputs. In a preferred embodiment of the invention, this is achieved by "sinking" the relevant inner conductor connection piece in the transformation inner conductor, the electrical properties being unaffected.

In a particularly preferred embodiment, what is known as a "blind hole" is formed in the connection head (opposite a lateral output). The blind hole enables symmetrical loading at the outputs, as a result of which it is possible to achieve a high level of phase balance and optimum power distribution between the outputs.

The invention also makes it possible to use a combination of different connection sockets, i.e. connection interfaces, for example what are known as 7-16 coaxial connectors or, for example, the aforementioned N connectors or threaded couplings in accordance with IEC standard 169-4, at the single ports acting as outputs for example.

A further advantage is that despite using the one-piece housing piece, the entire device can be produced in a cost-effective manner.

The housing-shaped, generally longitudinally extending outer conductor is preferably connected mechanically and electrically at an interface to the connection head or divider head by means of a screw connection, compression joint, soldered joint or another connection allowing intermodulation. However, said housing-shaped outer conductor 1 may also be configured integrally with the head piece.

The construction according to the invention of the device or circuit for separating or combining HF power will be explained hereinafter with reference to further drawings, in which.

The invention will be described hereinafter with reference to FIG. 3 onwards.

Figure 1:
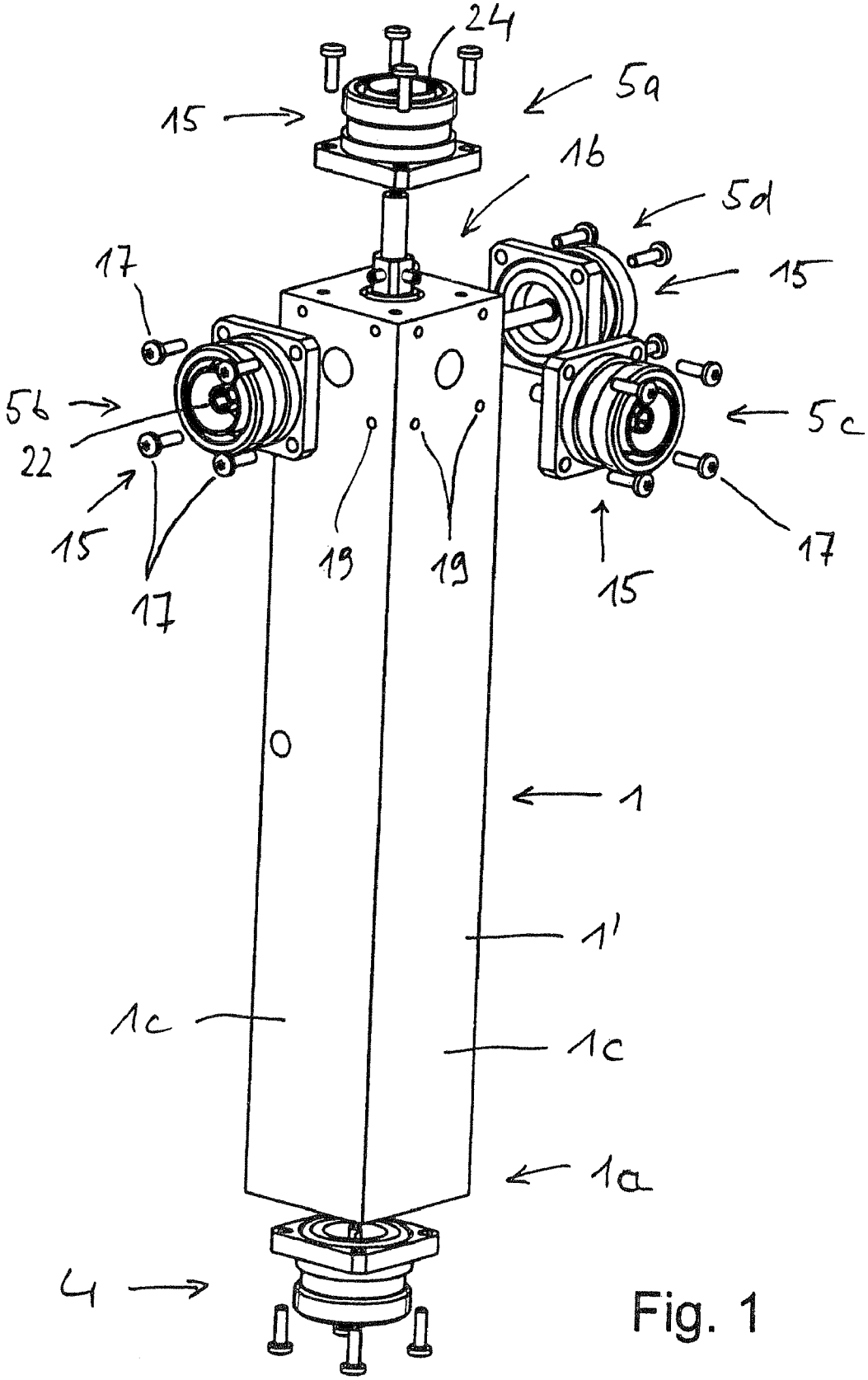
FIG. 1 is a schematic, three-dimensional, partly exploded view of a corresponding divider according to the prior art.
Figure 2:
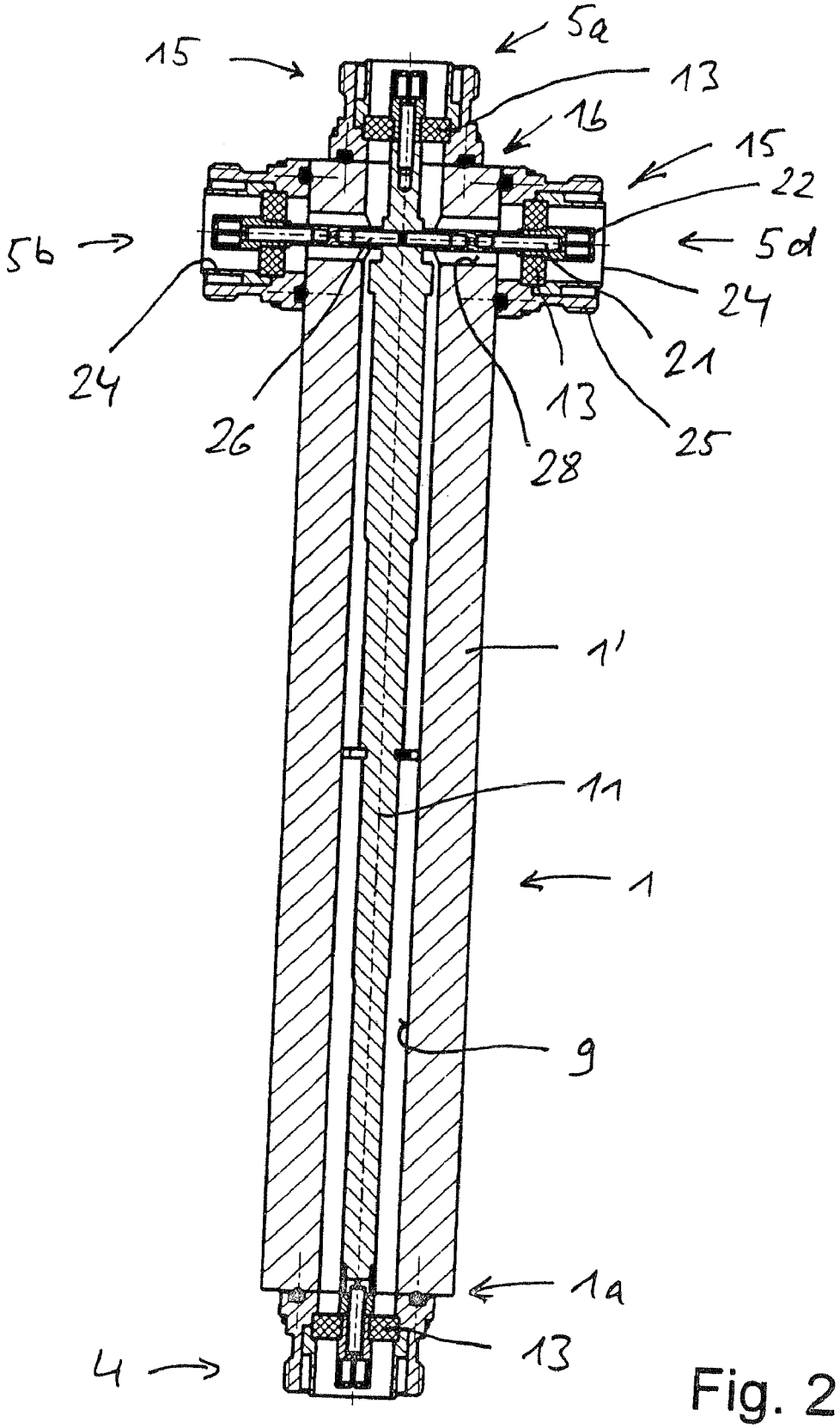
FIG. 2 is an axial longitudinal sectional view through the divider in accordance with FIG. 1 according to the prior art.
Figure 3:
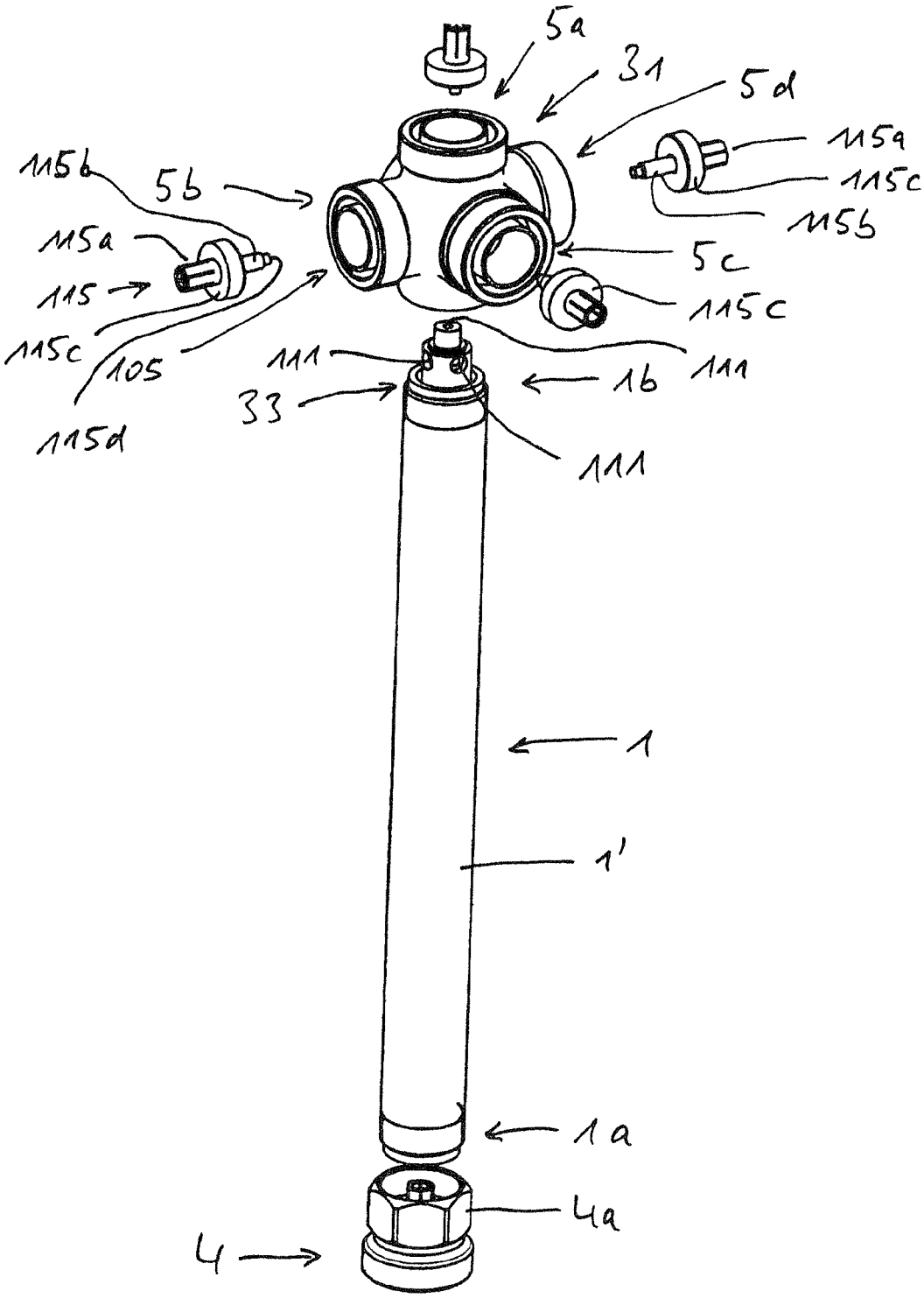
FIG. 3 is an exploded view of an embodiment according to the invention of a circuit for separating or combining HF power.
Figure 4:
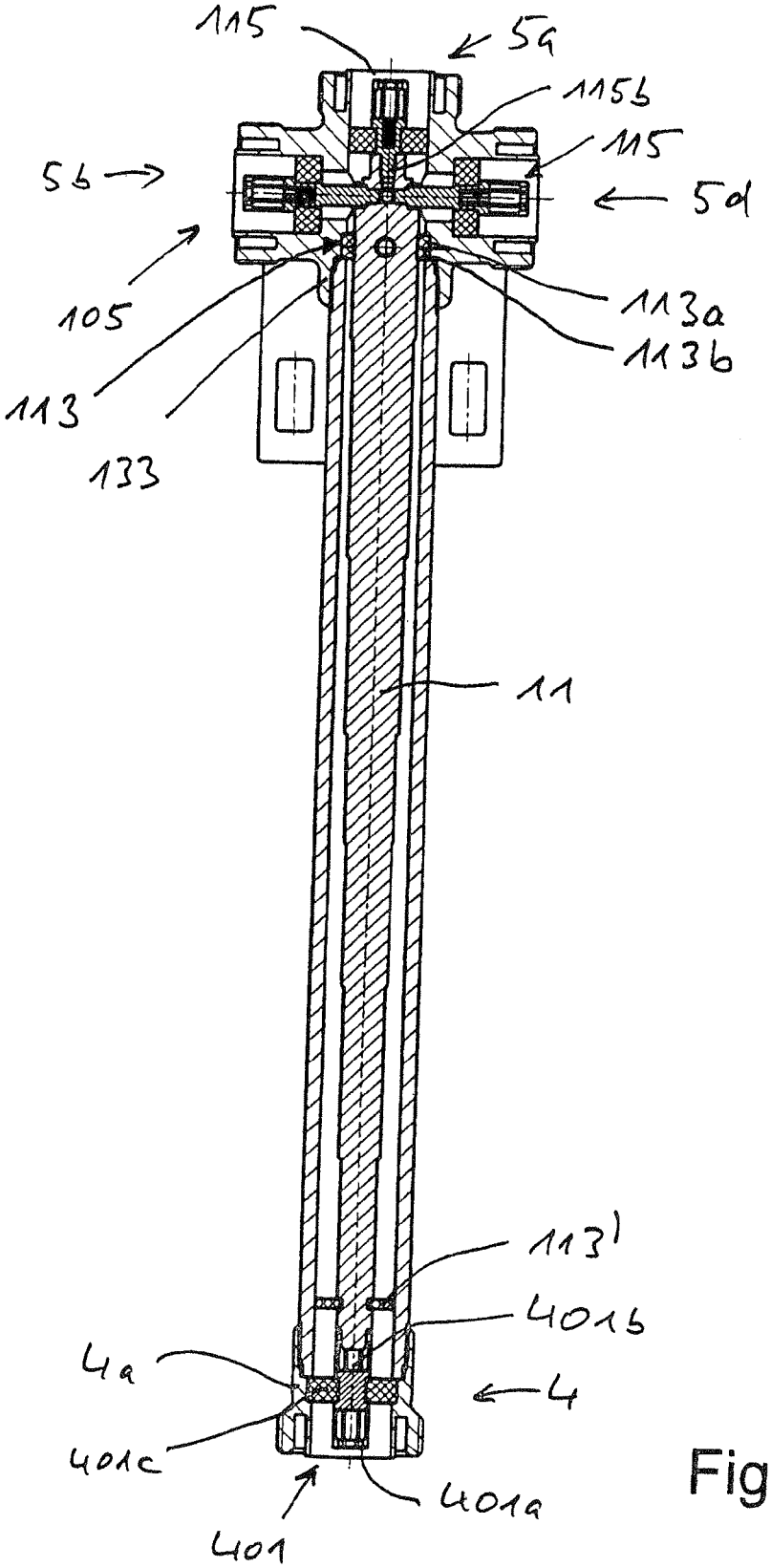
FIG. 4 is a corresponding sectional view through the embodiment according to the invention in accordance with FIG. 3.

FIG. 3 is an exploded three-dimensional view of a divider according to the invention and FIG. 4 is a longitudinal sectional view of a divider according to the invention, in which parts identical to those of the divider known from the prior art in accordance with FIGS. 1 to 2 are denoted with like reference numerals.

It can be seen from the illustration that the divider also comprises an outer conductor 1 and an inner conductor 11 configured as a coaxial conductor with a housing 1', in which the summation port 4 is arranged at the lower end-face end 1*a* of the housing. In the embodiment shown, said outer conductor 1 has a cylindrical cross-section. However, in a variant the outer conductor 1 may have a square cross-section or generally an n-polygonal or other cross-section, similarly to the embodiment in accordance with the prior art in accordance with FIGS. 1 and 2. In this respect there are no limitations.

At the opposite end 1*b* of the outer conductor and in contrast with the embodiment according to the prior art in accordance with FIGS. 1 and 2, a plurality of single ports is not directly provided but instead a one-piece head piece 31 is used and arranged at the upper end 1*b* of the outer conductor 1 at this point, on which head piece the single port 5*a* is provided in the axial extension of the outer conductor 1 and the other connection ports 5*b* and 5*d* are provided in the peripheral direction relative to the outer conductor 1 and are arranged in a plane so as to be offset relative to one another. In this embodiment two connection ports 5*b* and 5*d* are arranged in the axial direction and point away from one another, a central port 5*c* additionally being provided between said two ports 5*b* and 5*d*, which are arranged so as to extend at an angle of 180° relative to one another, and offset by 90° relative thereto, which central port is also arranged so as to be aligned at an angle of 90° relative to the upper port 5*a*. However, this 90° orientation is not mandatory. Any other geometrical shapes and orientations are also possible. Generally, an n-polygonal configuration is provided since the aforementioned angle may then also be smaller than 90° between two adjacent connection ports if the n-polygonal shape is, for example, 5-, 6- or 8-sided or more. Annular cross-sections may also be considered in principle.

In other words, an interface 33 is provided at the upper end 1*b* of the housing 1' acting as an outer conductor 1, at which interface a head piece 31 having more than one port (four ports in the embodiment shown) is provided, rather than a single connection port 5*a* as in the prior art (in accordance with FIGS. 1 and 2).

The head piece 31 with the single ports 5*a*, 5*b*, 5*c*, 5*d* which form the integral outer conductor connections 105 consists of a forged part, a cast part or a milled part. In other words, the head piece 31 serves as an outer conductor housing in which the single ports 5*a* to 5*d* serving as outer conductor connections 105 form an integral component part of the head piece 31, i.e. are rigidly connected to the actual portion of the head piece 31 and do not form a positive or non-positive connection but are materially connected (material connection). Material connections are connections in which the connection partners are joined together by atomic or molecular forces. At the same time they are non-detachable connections which can only be separated by destroying the connection means. Solders, welds, etc. are possible material connections. However, the head piece with the outer conductor connections belonging to the head piece is preferably produced from a single part which is positively connected and in the form of a forged part, a cast part or a milled part. If the head piece with the ports (i.e. the outer conductor connection 105) is produced by way of a forging process, it should preferably be produced in a warm forging process, including the ports serving as outer conductors (i.e. the outer conductor connections 105), in such a way that the head piece, together with the outer conductor connections, forms a single warm forged part which is easily handled.

Figure 7:
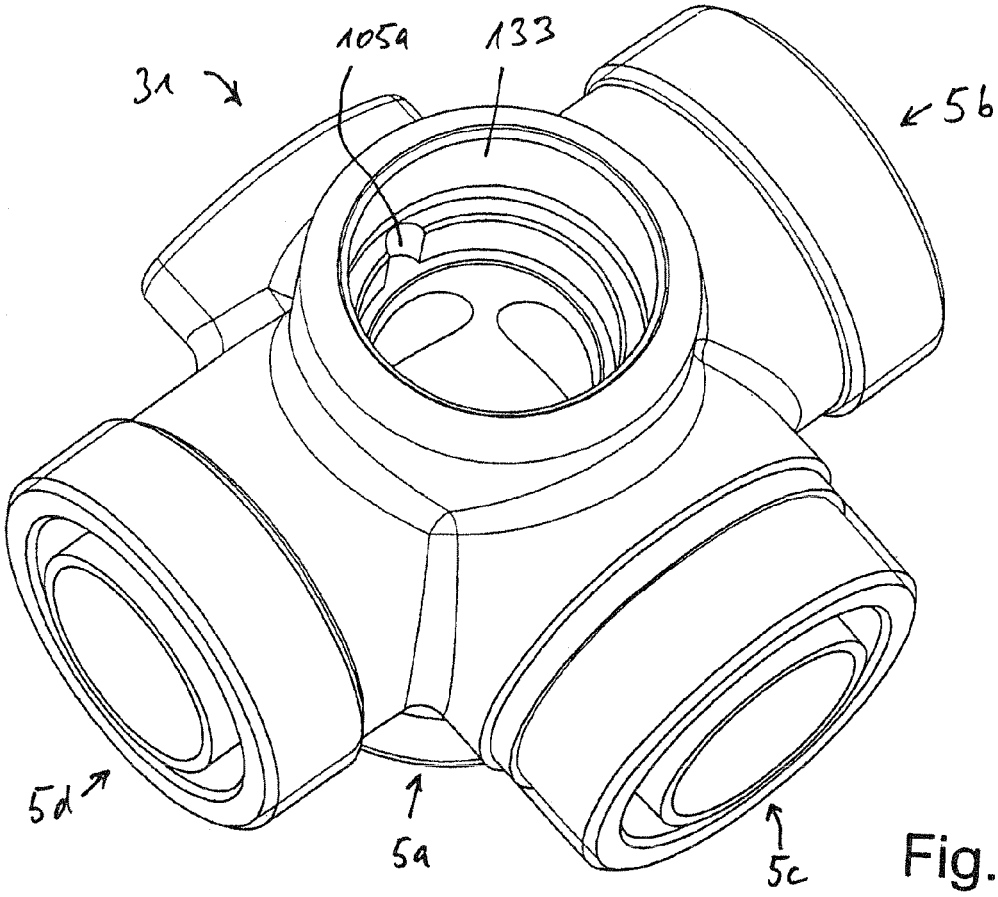
FIG. 7 is a three-dimensional view of the head piece viewed from the lower side, to which the inner and outer conductors are connected.
Figure 6:
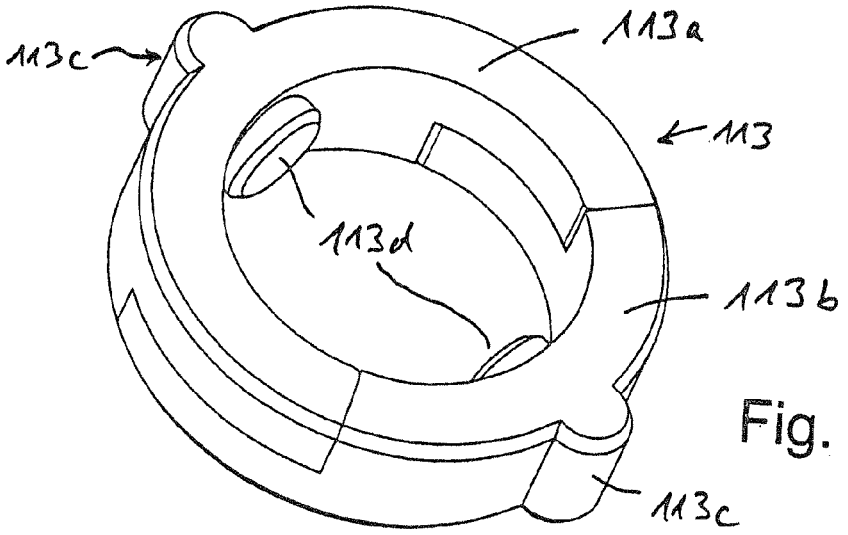
FIG. 6 is a three-dimensional view of the upper insulator consisting of two insulator halves in the region of or adjacent to the head piece of the circuit or divider head.

According to the sectional view in accordance with FIG. 4, it can further be seen that the inner conductor 11, which is also sometimes referred to as a transformation inner conductor 11, is held relative to the outer conductor 1 by means of two annular insulators 113*a* arranged above and with a further annular insulator 113' arranged closer to the stagnation port 4, the upper narrow insulator rings 113*a* being supported on and inwardly abutting the head piece 31. These two insulator rings orientate the inner conductor axially, radially and in rotation. As can be seen in FIG. 6, the annular insulator 113 which consists of two connectable annular portion insulator portions 113*a* and 113*b* is provided in the embodiment shown with two slightly protruding outer projections offset at 180° from one another which extend in the axial direction. Rotation is prevented in that when the transformation inner conductor 11 is inserted into the outer conductor 1, these projections 113*c* engage in corresponding longitudinal grooves 105*a* (in the three-dimensional view according to FIG. 7 one of the two inner grooves 105*a* can be seen at the connection port 5*a*, FIG. 7 showing the view from below the head piece 31 with the outer conductor 1 removed).

In order to prevent any rotation and to fix in place the insulator 113 consisting of the two parts, said insulator is provided on the inside and in the embodiment shown with two (in this case) annular or cylindrical radially inwardly protruding fixing projections 113*d* in the embodiment shown. These fix the respective insulator portion 113*a* or 113*b* to the inner conductor 11, The inner conductor 11 is thus also provided with a hole or recess 11*a* (shown in FIG. 4), in which one of the annular rings can be clipped until the projection 113*d* engages in said hole 11*a*. This hole or blind hole 11*a* is preferably provided with an undercut, it being possible for the projection 113*d* to be made of a suitable material (for example plastics material or Teflon) and to be configured in such a way that when it is inserted there is a slight snapping effect. The second annular portion insulator portion 113*c* may be inserted from the opposite side into a corresponding further hole in the inner conductor in such a way that once these two insulator halves 113*a* and 113*b* have been fixed in place, the annular insulator construction according to FIG. 6 is obtained and the insulator ring is thus held in place on the inner conductor 11 and thus also prevents the inner conductor from rotating.

As can be seen from the drawing according to FIG. 6, the insulator halves 113*a* and 113*b* are configured in such a way that, when viewed from above, they extend over slightly more than a 180° annular portion and therefore at their two open end regions are only half as tall so a correspondingly shaped second insulator part rotated through 180° can be connected to the first in such a way that a continuous support ring having the same continuous axial thickness is obtained.

According to the invention, the head piece 31 comprises integral connections 105 which form the single ports 5*a* to 5*d*. Into these connections 105, i.e. into the cylindrical or pot-shaped outer conductor of the connections 105, the inner conductors 115 are inserted, the inner conductors 115 being provided on the connection side (i.e. pointing outwardly) with a barrel spring 115*a* (in which a coaxial connection connector can be inserted via its inner conductor) and in the axial extension of said inner conductors an inner conductor pin 115*b* and an annular insulating support 115*c* being provided. This inner conductor part 115 prefabricated in this manner is inserted into the aforementioned connection 105 and into a corresponding threaded hole 111 via its threaded connection 115*d* on the assembly side, which threaded hole is formed to a corresponding depth in the inner conductor 11.

The head piece 31 itself also comprises on its connection side to the housing 1 a socket-shaped connection 133, in which the upper end 1*b* of the housing 1 can be screwed via its outer thread into a corresponding inner thread in the connection 133 of the head piece 31. The transformation inner conductor 11 is thus distanced and centered relative to the head piece 13 in an insulated manner via the aforementioned insulator rings 113.

Instead of the screw connection at the socket-shaped connection 113, in this case the outer conductor may also be connected to the connection or divider head (what is known as the head piece 31) by another suitable connection which allows intermodulation, for example a compression joint, soldered joint or the like.

At the summation port 4 a prepared socket with a fixing screw 4*a* can also be unscrewed at an outer thread at the lower end 1*a* of the housing 1, in fact with a prepared inner conductor 401 comprising outwardly pointing barrel supports 401*a* and an inner conductor pin 401*b* connected axially in the direction of the inner conductor 11, this unit in turn being held via an annular insulating support 401*c*. In this case, the inner conductor 401 is also connected via a threaded connection to the transformation inner conductor 11. The inner conductor 11 is also held in a centered manner via the insulating support 401*c*. Not only the aforementioned upper insulator ring 113 consisting of the two insulator halves 113*a* and 113*b*, but also the lower annular insulator support 113' is used to insert the inner conductor 11 into the outer conductor 1. The insulator 113 and the insulator support 113' thus center the inner conductor 11 since the inner conductor is interrupted between the insulator support 113 and the insulator support 401*c* by the inner conductor pin contact 401*b*. The contact 401*b* thus compensates differences in tolerance and length.

In a variant of the embodiment shown, a construction identical to that for the other connection ports 5*b* to 5*d* may be selected for the uppermost port 5*a*, i.e. a construction with an inner conductor 115 of the same length. In the embodiment shown according to FIGS. 3 and 4, this inner conductor, i.e. the inner conductor pin 115*b*, is slightly shorter than the inner conductor 115 for the other connection ports 5*b* to 5*d*.

Figure 5:
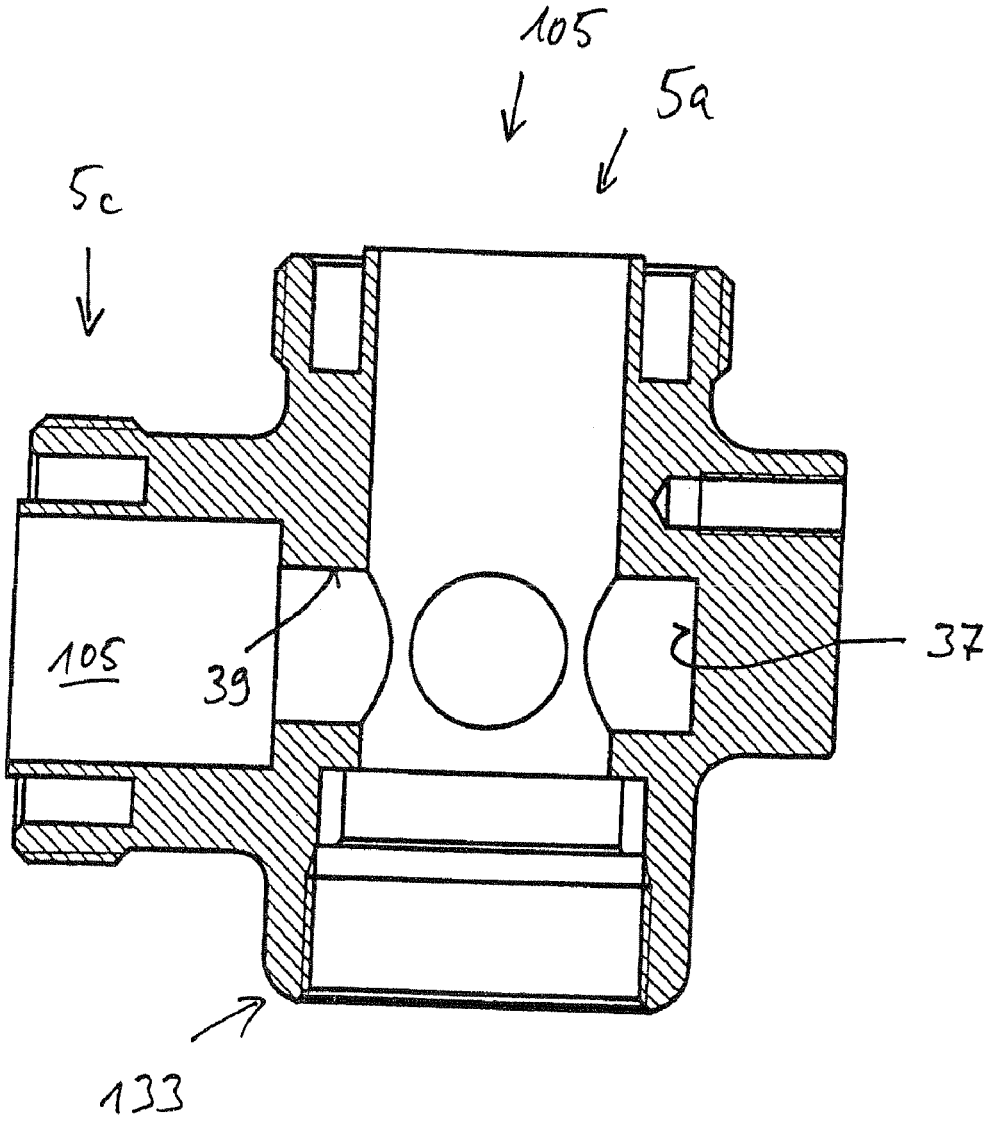
FIG. 5 is an axial sectional view through the circuit or divider head.

It can also be seen from the cross-sectional view according to FIG. 5 that no further single port is provided opposite the single port 5*c* but, in this case, an inwardly blind hole 37 is formed in the material of the head piece 31. This blind hole 37 is arranged in the direct axial extension of the hole 39 which forms the axial extension hole for the single port 5*c* having a greater internal diameter. The hole 39 thus opens out into a hole 40 arranged in the axial extension of the inner conductor 11 (similarly to the blind hole 37), which hole 40 leads to the upper connection 105 of the single port 5*a*. This blind hole 37 opposite the front output 5*c* enables symmetrical loading at the outputs, a high level of phase balance and power distribution between the outputs being obtained with extremely simple means.

The invention claimed is:

1. Circuit for, in use, separating or combining high frequency power, the circuit comprising:

a coaxial structure comprising (a) an outer conductor, and (b) a transformation inner conductor disposed within the coaxial outer conductor, the transformation inner conductor extending in a axial direction, the outer conductor having first and second ends, the first end having an end face;

a coaxial summation port provided at one of the end-face ends of the outer conductor first end, at the second end of the outer conductor, a head piece comprising at least two single ports, which said ports comprise outer conductor connections, the at least two single ports each being axially penetrated by a respective inner conductor which is connected to the transformation inner conductor, and insulating supports that at least indirectly support the transformation inner conductor relative to the outer conductor, the head piece comprising the at least two single ports being formed in a single piece so as to avoid mechanical connection points, the head piece comprising the at least two single ports structured to form integral outer conductor connections being forged or cast, at least one the single ports extending traversely to the axial direction of the transformation inner conductor, a blind hole being formed in the head piece in axial extension of the single port that extends transversely to the axial direction of the transformation inner conductor, which the blind hole is outwardly closed.

2. Circuit according to claim 1, wherein the respective inner conductors axially penetrating the single ports are each screwed into an upper end of the transformation inner conductor.

3. Circuit according to claim 1, further comprising at least one insulating support that holds the respective inner conductors in the respective single ports.

4. Circuit according to claim 1, wherein at least one of the respective inner conductors is provided with an outwardly pointing barrel spring.

5. Circuit according to claim 1, wherein the respective inner conductors are provided at connection ends thereof with an outer thread which is screwed into an inner thread at an upper end of the transformation inner conductor.

6. Circuit according to claim 1, wherein the respective inner conductors are oriented transverse to an axial longitudinal direction of the outer conductor, and are configured so as to all have equal lengths and diameters.

7. Circuit according to claim 6, wherein the inner conductor arranged in the single port which extends transverse to the axial direction of the transformation inner conductor is disposed in axial extension of the transformation inner conductor, and is configured so as to be identical to the respective inner conductors of other single port(s).

8. Circuit according to claim 6, wherein the inner conductor arranged in the single port which extends transverse to the axial direction of the transformation inner conductor is configured so as to be different from respective inner conductor (s) of other single port(s).

9. Circuit according to claim 1, wherein the single port extending transverse is oriented perpendicularly to the axial direction of the transformation inner conductor.

10. Circuit according to claim 9, further including structure defining, for at least one single port, an additional hole which extends in the axial extension of the at least one single port and opens out into an axial hole which penetrates through the head piece in the axial extension of the respective inner conductor for said at least one single port.

11. Circuit according to claim 1, wherein the head piece is provided, opposite the single port arranged in the axial extension of the outer conductor, with a connection or joint allowing intermodulation for mechanical connection to the outer conductor, in the form of a threaded connection, a compression joint or a soldered joint.

12. Circuit according to claim 1, wherein the head piece and the outer conductor are integrally formed.

13. Circuit according to claim 1, wherein the summation port is structured to be screwed on at the lower end of the outer conductor by way of a screw connection.

14. Circuit according to claim 13, wherein the screw connection for the summation port comprises an inner conductor having an outwardly pointing barrel spring, and further including an insulating support configured to hold the summation port inner conductor relative to the sleeve-shaped outer conductor.

15. Circuit according to claim 1, further including at least two insulators arranged to be offset in the axial direction, the at least two insulators contactlessly holding the transformation inner conductor relative to the outer conductor.

16. Circuit according to claim 15, wherein at least one of the insulators comprises at least two connectable portions and at least one inwardly protruding projection or inwardly projecting lug, the inner conductor defining a hole or recess corresponding to the inwardly protruding projection or inwardly projecting lug, the inwardly protruding projection or inwardly projecting lug structured to be inserted into a corresponding hole or recess in the inner conductor to hold the at least one insulator in place.

17. Circuit according to claim 15, wherein the at least two insulators comprise at least one radially outwardly protruding projection the head piece defining a corresponding longitudinal groove or longitudinal recess at the connection portion structured to engage the projection, the engagement of the projection and groove or recess in use connecting inner and outer conductors to the head piece.

18. A radio frequency divider/combiner comprising:

a tubular outer conductor having first and second ends, a coaxial summation port disposed at the outer conductor first end, a transformation inner conductor coaxially disposed within the tubular outer conductor, insulating supports that at least indirectly support the transformation inner conductor relative to the tubular outer conducetor, a unitary forged or cast head piece disposed at the outer conductor second end, the unitary head piece comprising plural single ports, each said plural single ports being conductively coupled to the tubular outer conductor so as to provide outer conductor connections and each being axially penetrated by a respective inner conductor electrically connected to the transformation inner conductor, at least one of the plural single ports extending transverse to the transformation inner conductor axial direction, the head piece defining an outwardly closed blind hole in axial extension of the single port that extends transverse to the transformation inner conductor axial direction.

* * * * *